US008184073B2

(12) United States Patent
Choi

(10) Patent No.: US 8,184,073 B2
(45) Date of Patent: May 22, 2012

(54) PLASMA DISPLAY APPARATUS AND METHOD OF DRIVING THE SAME

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 438 days.

(21) Appl. No.: 12/500,452

(22) Filed: Jul. 9, 2009

(65) Prior Publication Data

US 2009/0273545 A1 Nov. 5, 2009

Related U.S. Application Data

(63) Continuation of application No. 11/113,971, filed on Apr. 26, 2005, now Pat. No. 7,944,409.

(30) Foreign Application Priority Data

Apr. 27, 2004 (KR) ..... 10-2004-0029211

(51) Int. Cl.
*G09G 3/28* (2006.01)

(52) U.S. Cl. ..... 345/67; 345/60; 315/169.4

(58) Field of Classification Search ..... 345/60–68, 345/208–210; 315/169.4
See application file for complete search history.

(56) References Cited

U.S. PATENT DOCUMENTS

| | | | | |
|---|---|---|---|---|
| 6,160,529 | A * | 12/2000 | Asao et al. | 345/60 |
| 6,940,475 | B2 * | 9/2005 | Shiizaki et al. | 345/60 |
| 2001/0028225 | A1 | 10/2001 | Awamoto | |
| 2002/0021265 | A1 | 2/2002 | Ishii et al. | |
| 2002/0097200 | A1 | 7/2002 | Setoguchi et al. | |
| 2002/0118148 | A1 | 8/2002 | Homma et al. | |
| 2002/0186184 | A1 | 12/2002 | Lim | |
| 2003/0174105 | A1 * | 9/2003 | Kanazawa | 345/63 |
| 2003/0193453 | A1 * | 10/2003 | Mizobata | 345/60 |
| 2003/0218580 | A1 | 11/2003 | Yokoyama et al. | |
| 2005/0237278 | A1 | 10/2005 | Choi | |
| 2009/0273545 | A1 | 11/2009 | Choi | |

FOREIGN PATENT DOCUMENTS

| | | | |
|---|---|---|---|
| CN | 1366287 | A | 8/2002 |
| CN | 1480916 | A | 3/2004 |
| EP | 1 227 462 | A2 | 7/2002 |
| JP | 2001-272946 | A | 10/2001 |
| JP | 2002-215088 | A | 7/2002 |
| JP | 2002-258795 | A | 9/2002 |
| JP | 2003-345292 | A | 12/2003 |
| KR | 10-2001-0091869 | A | 10/2001 |
| KR | 10-2005-0104050 | A | 11/2005 |

* cited by examiner

*Primary Examiner* — Amare Mengistu
*Assistant Examiner* — Hong Zhou
(74) *Attorney, Agent, or Firm* — Birch, Stewart, Kolasch & Birch, LLP

(57) ABSTRACT

A plasma display apparatus and a method of driving the same are disclosed. The plasma display apparatus includes a plasma display panel in which a plurality of scan electrodes, sustain electrodes, and address electrodes are formed on substrates to form a discharge cell and electrode driving parts for driving the scan electrodes, the sustain electrodes, and the address electrodes. The plurality of scan electrodes are divided into a plurality of scan electrode groups and the driving parts are controlled such that a voltage different from a scan bias voltage is applied for a predetermined time in the address period of one or more scan electrode groups among the plurality of scan electrode groups.

5 Claims, 7 Drawing Sheets

RELATED ART

RELATED ART

RELATED ART

PLASMA DISPLAY APPARATUS AND METHOD OF DRIVING THE SAME

CROSS REFERENCE TO RELATED APPLICATIONS

This application is a continuation of application Ser. No. 11/113,971 filed on Apr. 26, 2005 now U.S. Pat. No. 7,944,409, which claims priority under 35 U.S.C. §119(a) on Patent Application No. 10-2004-0029211 filed in Korea on Apr. 27, 2005. The entire contents of each of these applications are hereby incorporated by reference.

BACKGROUND OF THE INVENTION

1. Field of the Invention

The present invention relates to a plasma display apparatus, and more particularly to a plasma display apparatus capable of generating stable discharge under the conditions of high resolution and high temperature to realize a screen and a method of driving the same.

2. Description of the Background Art

In general, a plasma display panel (PDP) emits light from a fluorescent body by ultraviolet (UV) rays of 147 nm generated when an inactive mixed gas such as He+Xe or Ne+Xe is discharged to display images including characters and graphics.

FIG. 1 is a perspective view illustrating the structure of a conventional three-electrode AC surface discharge type PDP having discharge cells arranged in a matrix. Referring to FIG. 1, a three-electrode AC surface discharge type PDP 100 includes a scan electrode 11*a* and a sustain electrode 12*a* formed on a top substrate 10 and an address electrode 22 formed on a bottom substrate 20. The scan electrode 11*a* and the sustain electrode 12*a* are formed of a transparent electrode, for example, indium-tin-oxide (ITO), respectively. Metal bus electrodes 11*b* and 12*b* for reducing resistance are formed in the scan electrode 11*a* and the sustain electrode 12*a*, respectively. A top dielectric layer 13*a* and a protective layer 14 are laminated on the top substrate 10 on which the scan electrode 11*a* and the sustain electrode 12*a* are formed. Wall charges generated during plasma discharge are accumulated on the top dielectric layer 13*a*. The protective layer 14 prevents the top dielectric layer 13*a* from being damaged by sputtering generated during plasma discharge and improves efficiency of emitting secondary electrons. MgO is commonly used as the protective layer 14.

On the other hand, a bottom dielectric layer 13*b* and a partition wall 21 are formed on a bottom substrate 20 on which the address electrode 22 is formed and the surfaces of the bottom dielectric layer 13*b* and the partition wall 21 are coated with a fluorescent body layer 23. The address electrode 22 is formed to intersect the scan electrode 11*a* and the sustain electrode 12*a*. The partition wall 21 is formed to run parallel with the address electrode 22 to prevent ultraviolet (UV) rays and visible rays generated by discharge from leaking to an adjacent discharge cell. The fluorescent body layer 23 is excited by the UV rays generated during plasma discharge to generate any one visible ray among red (R), green (G), and blue (B) visible rays. An inactive mixed gas such as He+Xe or Ne+Xe for discharge is implanted into a discharge space of discharge cells partitioned by the partition wall 21 provided between the top substrate 10 and the bottom substrate 20. A method of driving a conventional PDP having such a structure will be described with reference to FIG. 2.

FIG. 2 illustrates driving waveforms in accordance with the method of driving the conventional PDP. As illustrated in FIG. 2, the waveforms in accordance with the method of driving the conventional PDP are composed of a reset period, an address period, and a sustain period and the reset period is composed of a set-up period and a set-down period.

A ramp up pulse is applied to scan electrodes Y in the set-up period such that positive wall charges are accumulated on the sustain electrodes Z and the address electrodes X and that negative wall charges are accumulated on the scan electrodes Y.

A ramp down pulse is applied in the set-down period such that the wall charges that are excessively accumulated by the high pressure ramp up pulse are uniformly reduced to a certain level.

In the address period, address discharge is generated by the scan pulse of the scan electrodes Y and the data pulse of the address electrodes X and a sustain voltage Vs is maintained in the sustain electrodes Z. At this time, the amount of the bias voltage Vs applied to the sustain electrodes Z is maintained such that the bias voltage Vs does not generate discharge with the scan pulse applied to the scan electrodes Y.

In the sustain period, sustain pulses are alternately applied to the scan electrodes Y and the sustain electrodes Z such that sustain discharge is generated.

FIG. 3 illustrates the state of wall charges in accordance with the driving waveforms of the conventional PDP. FIG. 3(*a*) illustrates the state of the wall charges formed by the set-up discharge generated by the high pressure ramp up pulse in the set-up period. It is noted that a large amount of wall charges are formed on the scan electrodes Y, the sustain electrodes Z, and the address electrodes X by the high pressure ramp up pulse.

FIG. 3(*b*) illustrates the state of wall charges formed in accordance with a discharge process by the ramp down pulse in the set-down period. The wall charges that are excessively accumulated by the ramp down pulse are reduced to a certain level such that the wall charges of the respective cells become uniform.

FIG. 3(*c*) illustrates the state of wall charges immediately after the scan pulse and the data pulse are applied to the scan electrodes Y and the address electrodes X, respectively, in the address period, which is inverse to the state of the wall charges of FIG. 3(*b*).

FIG. 3(*d*) illustrates the state of wall charges in the second half of the address period in the cell where address discharge was previously generated in the first half of the address period, in which more wall charges are lost than in FIG. 3(*c*). The state of the wall charges of the cell, which are generated by the address discharge in the first half of the address period, must be maintained to the second half of the address period. However, when a large amount of wall charges are lost as illustrated in FIG. 3(*d*), the sustain discharge that follows the address discharge may not be normally performed.

The reason why the state of the wall charges in the cell where the address discharge was previously generated is not maintained to the second half of the address period but the wall charges are lost as illustrated in FIG. 3(*d*) is as follows.

The higher the resolution of a PDP is, the longer the address period is. Therefore, the wall charges formed by the address discharge of an initial scan line as illustrated in FIG. 3(*c*) are in the same voltage state of the scan electrodes Y and the sustain electrodes Z to the point of time where the address period is finished as illustrated in FIG. 3(*d*). Therefore, after the lapse of a large amount of time, charges are naturally combined with each other such that the wall charges are lost.

A scan bias voltage Vsc for generating the scan pulse is applied to the initial scan electrodes Y in which the address period starts. According as the scan bias voltage Vsc becomes higher, the scan bias voltage Vsc holds the negative wall charges formed on the scan electrodes Y before scan is performed.

However, although the positive wall charges are formed on the scan electrodes Y after the address discharge is generated, the scan bias voltage Vsc is maintained in the scan electrodes Y. Therefore, according as the time for which the scan bias voltage Vsc is maintained increases, the positive wall charges formed after the address discharge are lost. Such a phenomenon easily occurs when resolution increases and a plasma display apparatus is operated at a high temperature.

SUMMARY OF THE INVENTION

Accordingly, an object of the present invention is to solve at least the problems and disadvantages of the background art.

It is an object of the present invention to provide a plasma display apparatus capable of preventing wall charges from being lost immediately after address discharge when resolution increases and the plasma display apparatus is operated at a high temperature such that sustain discharge can be stably generated without miss-discharge and a method of driving the same.

The plasma display apparatus according to the present invention includes a plasma display panel in which a plurality of scan electrodes, sustain electrodes, and address electrodes are formed on substrates to form a discharge cell and electrode driving parts for driving the scan electrodes, the sustain electrodes, and the address electrodes. The plurality of scan electrodes are divided into a plurality of scan electrode groups and the driving parts are controlled such that a voltage different from a scan bias voltage is applied for a predetermined time in the address period of one or more scan electrode groups among the plurality of scan electrode groups.

In the method of driving a plasma display apparatus according to the present invention, a plurality of sub-fields are divided into a reset period, an address period, and a sustain period and signals are supplied to the plurality of scan electrodes, sustain electrodes, and address electrodes in the respective periods to drive the plasma display apparatus. At this time, the plurality of scan electrodes are divided into a plurality of scan electrode groups and a voltage different from a scan bias voltage is applied for a predetermined time in the address period of one or more scan electrode groups among the plurality of scan electrode groups.

According to the present invention, the scan electrodes are divided into a plurality of groups such that different driving waveforms are applied to the divided groups. Therefore, it is possible to prevent wall charges from being lost due to high resolution and a high temperature. As a result, stable discharge can be performed.

BRIEF DESCRIPTION OF THE DRAWINGS

The present invention will be described in detail with reference to the following drawings in which like numerals refer to like elements.

DETAILED DESCRIPTION OF PREFERRED EMBODIMENTS

Figure 1:
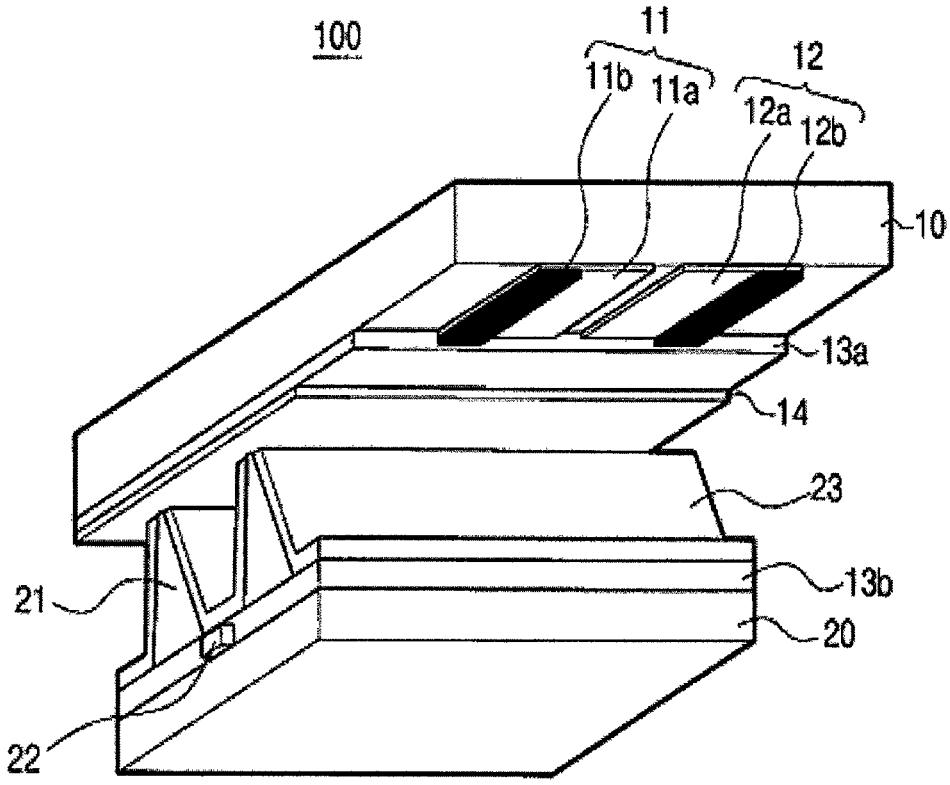
FIG. 1 is a perspective view illustrating the structure of a conventional three-electrode AC surface discharge type plasma display panel (PDP) having discharge cells arranged in a matrix.
Figure 2:
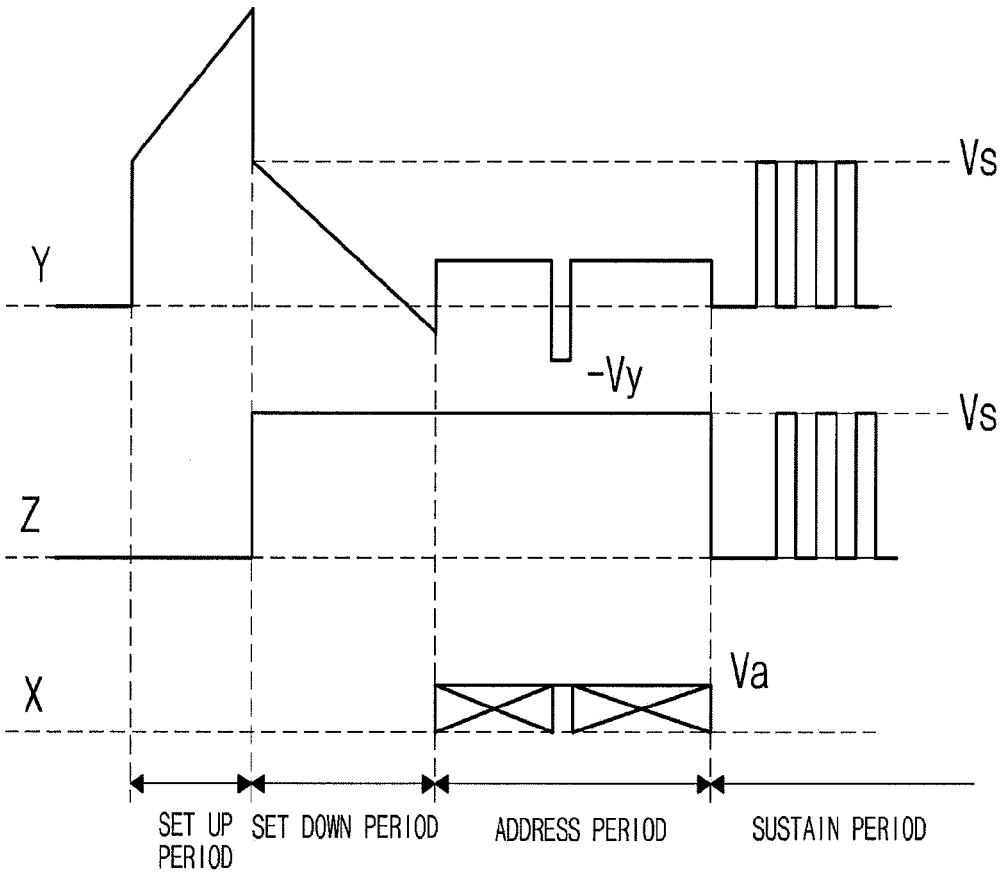
FIG. 2 illustrates waveforms in accordance with a method of driving the conventional PDP.

Preferred embodiments of the present invention will be described in a more detailed manner with reference to the drawings.

A plasma display apparatus according to the present invention includes a plasma display panel in which a plurality of scan electrodes, sustain electrodes, and address electrodes are formed on substrates to form a discharge cell and electrode driving parts for driving the scan electrodes, the sustain electrodes, and the address electrodes. The plurality of scan electrodes are divided into a plurality of scan electrode groups and the driving parts are controlled such that a voltage different from a scan bias voltage is applied for a predetermined time in the address period of one or more scan electrode groups among the plurality of scan electrode groups.

The predetermined time in which the voltage different from the scan bias voltage is applied is the second half of the address period in the first half scan electrode group in which scan is performed first among the plurality of scan electrode groups.

The voltage different from the scan bias voltage is smaller than the scan bias voltage and larger than the scan pulse voltage.

The voltage different from the scan bias voltage is in a ground level.

The predetermined time in which the voltage different from the scan bias voltage is applied is the first half of the address period in the second half scan electrode group where scan is performed later among the plurality of scan electrode groups.

The voltage different from the scan bias voltage is larger than the scan bias voltage and equal to or smaller than the voltage of a ramp up pulse applied in a reset period.

The voltage different from the scan bias voltage is a sustain voltage.

The predetermined time in which the voltage different from the scan bias voltage is applied is the second half of the address period in the case of the first half scan electrode group in which scan is performed first among the plurality of scan electrode groups and is the first half of the address period in the case of the second half scan electrode group in which scan is performed later among the plurality of scan electrode groups.

The number of plurality of scan electrode groups is two.

In a method of driving a plasma display apparatus according to the present invention, a plurality of sub-fields are divided into a reset period, an address period, and a sustain period and signals are supplied to the plurality of scan electrodes, sustain electrodes, and address electrodes in the respective periods to drive the plasma display apparatus. According to the method, the plurality of scan electrodes are divided into a plurality of scan electrode groups and a voltage different from a scan bias voltage is applied for a predetermined time in the address period of one or more scan electrode groups among the plurality of scan electrode groups.

Hereinafter, preferred embodiments of the present invention will be described in detail with reference to the attached drawings.

Figure 4:
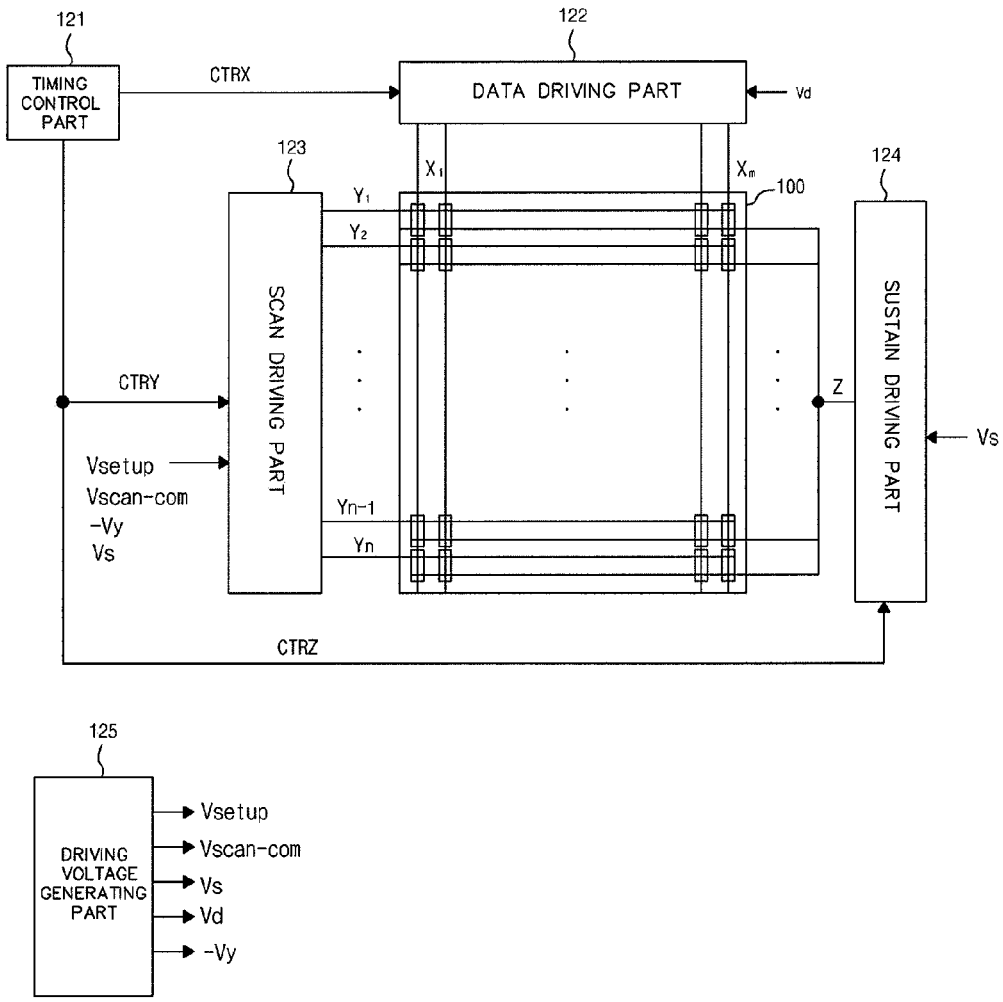
FIG. 4 schematically illustrates a plasma display apparatus according to the present invention.

FIG. 4 schematically illustrates a plasma display apparatus according to the present invention. As illustrated in FIG. 4, the plasma display apparatus according to the present invention includes a plasma display panel (PDP) 100, a data driving part 122 for supplying data to address electrodes X1 to Xm formed on a bottom substrate (not shown) of the PDP 100, a scan driving part 123 for driving scan electrodes Y1 to Yn, a sustain driving part 124 for driving sustain electrodes Z that are common electrodes, a timing control part 121 for controlling the data driving part 122, the scan driving part 123, and the sustain driving part 124 when the PDP is driven, and a driving voltage generating part 125 for supplying necessary driving voltage to the respective driving parts 122, 123, and 124.

In the PDP 100, a top substrate (not shown) and a bottom substrate (not shown) are attached to each other by uniform distance. On the top substrate, a plurality of electrodes, for example, the scan electrodes Y1 to Yn and the sustain electrodes Z are formed to make pairs. On the bottom substrate, the address electrodes X1 to Xm are formed so as to intersect the scan electrodes Y1 to Yn and the sustain electrodes Z.

Data that is inverse gamma corrected and error diffused by an inverse gamma correcting circuit and an error diffusing circuit that are not shown and then, is mapped by a sub-field mapping circuit in each sub-field is supplied to the data driving part 122. The data driving part 122 samples and latches data in response to a timing control signal CTRX from the timing control part 121 and supplies the data to the address electrodes X1 to Xm.

The scan driving part 123 supplies a rising ramp waveform Ramp-up and a falling ramp waveform Ramp-down to the scan electrodes Y1 to Yn under the control of the timing control part 121 in a reset period. Also, the scan driving part 123 sequentially supplies the scan pulse Sp of a scan voltage −Vy to the scan electrodes Y1 to Yn while maintaining a scan bias voltage Vsc under the control of the timing controller 121 in an address period. At this time, the scan driving part 123 may be divided into a first scan driving part 123*a* and a second scan driving part 123*b* such that the plurality of scan electrodes Y1 to Yn formed in the PDP are divided into a first half scan electrode group and a second half scan electrode group in accordance with the order of scan time to be driven. That is, the first scan driving part 123*a* drives the scan electrode group $Y_{top}$ on the PDP in the address period and the second scan driving part 123*b* drives the scan electrode group $Y_{bottom}$ under the PDP in the address period. Also, the scan driving part 123 applies a voltage different from the scan bias voltage for a predetermined time in the address period of one scan electrode group among the scan electrode groups divided into a plurality of groups, which will be described in detail in a method of driving the plasma display apparatus according to the present invention to be mentioned later.

The sustain driving part 124 supplies the bias voltage of a sustain voltage Vs to the sustain electrodes Z under the control of the timing control part 121 in a period where the falling ramp waveform Ramp-down is generated and in an address period and the sustain driving circuit included in the sustain driving part 124 alternately operates together with the sustain driving circuit included in the scan driving part 123 in the sustain period to supply the sustain pulse sus to the sustain electrodes Z.

The timing control part 121 receives vertical/horizontal synchronizing signals and a clock signal, generates timing control signals CTRX, CTRY, and for controlling the operation timings and the synchronizations of the respective driving parts 122, 123, and 124 in the reset period, the address period, and the sustain period, and supplies the timing control signals CTRX, CTRY, and CTRZ to the corresponding driving parts 122, 123, and 124 to control the respective driving and control parts 122, 123, and 124.

On the other hand, a sampling clock for sampling data, a latch control signal, and a switch control signal for controlling the on/off times of a sustain driving circuit and a driving switch element are included in the data control signal CTRX. A switch control signal for controlling the on/off times of the sustain driving circuit and the driving switch element in the scan driving part 123 is included in the scan control signal CTRY. A switch control signal for controlling the on/off times of the sustain driving circuit and the driving switch element in the sustain driving part 124 is included in the sustain control signal CTRZ.

The driving voltage generating part 125 generates a set-up voltage Vsetup, a scan common voltage Vscan-com, a scan voltage −Vy, a sustain voltage Vs, and a data voltage Vd. Such driving voltages may change due to the composition of a discharge gas or the structure of a discharge cell.

A method of driving the plasma display apparatus according to the present invention having such a structure will be described with reference to FIG. 5.

Figure 5:
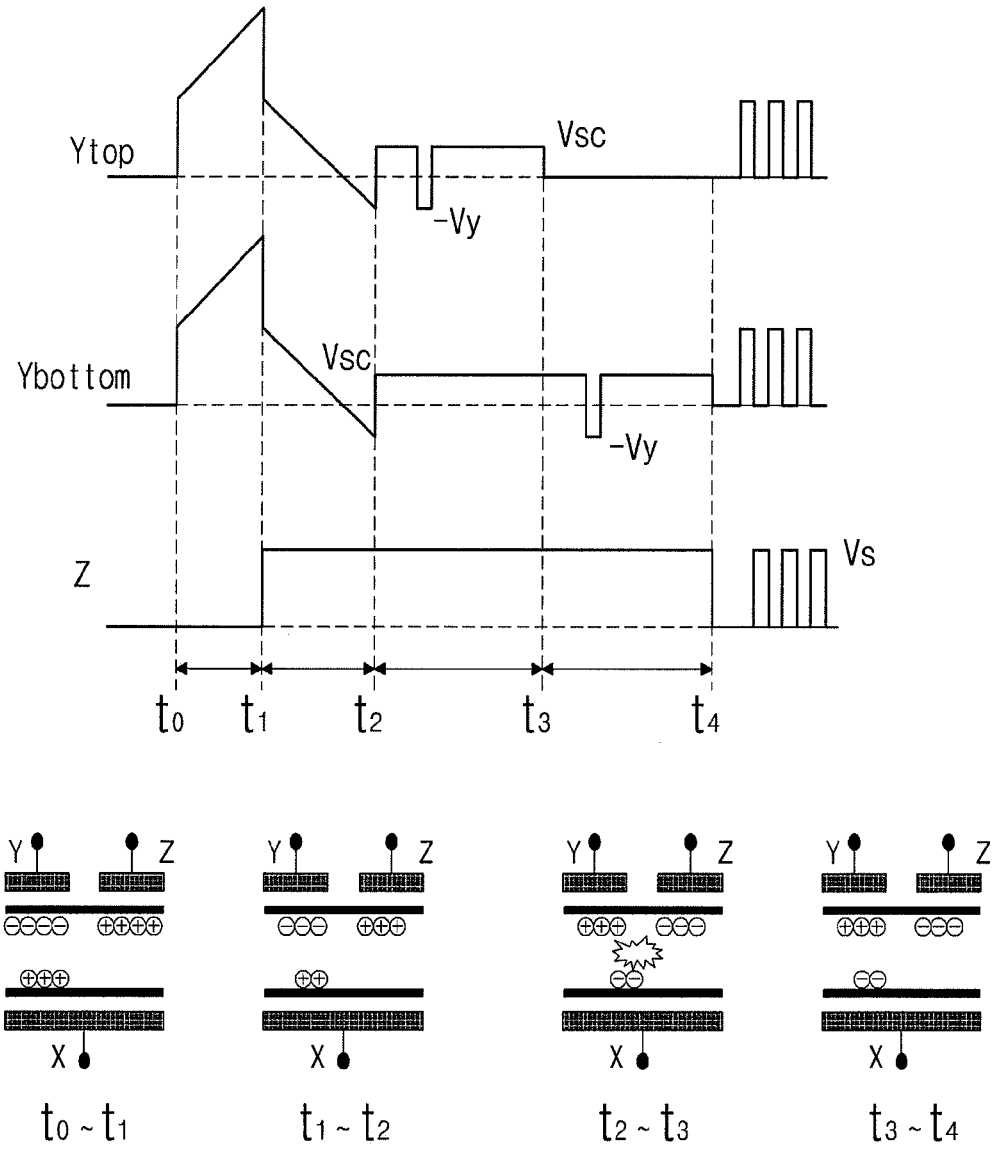
FIG. 5 illustrates waveforms and the states of wall charges for describing a first driving method of the plasma display apparatus according to the present invention.

FIG. 5 illustrates waveforms and the states of wall charges for describing a first driving method of the plasma display apparatus according to the present invention. As illustrated in FIG. 5, according to the first driving method of the plasma display apparatus of the present invention, the scan electrodes Y formed in the PDP are divided into two groups, that is, the first half scan electrode group $Y_{top}$ and the second half scan electrode group $Y_{bottom}$ to be driven. Here, the first half scan electrode group means the group in which scan is performed first based on the scan order of the scan electrodes formed in the PDP and the second half scan electrode group means the group in which scan is performed later based on the scan order. Also, in FIG. 5, the scan electrodes formed in the PDP are divided into two groups to be driven. However, the scan electrodes may be divided into a plurality of, that is, two or more scan electrode groups to be driven.

A reset pulse is simultaneously applied to the first half scan electrode group and the second half scan electrode group divided into two groups in the reset period.

Then, the first half scan electrode group $Y_{top}$ and the second half scan electrode group $Y_{bottom}$ are differently driven in the address period. That is, in the first half t2 and t3 of the address period, a pulse of a scan voltage is applied to the first half scan electrode group while maintaining the scan bias voltage Vsc such that the address discharge is performed. In the second half t3 and t4 of the address period, the scan bias voltage Vsc is not maintained but a ground level is maintained. On the other hand, in FIG. 5, in the first half scan electrode group, the voltage maintained in the second half of the address period is described as the ground level only. However, the voltage that maintains the first half scan electrode group in the second half of the address period is smaller than the scan bias voltage and larger than the scan voltage for the scan pulse.

Also, when the voltage that maintains the first half scan electrode group in the second half of the address period is the scan voltage −Vy, it is possible to prevent wall charges from being lost. However, in this case, since the scan voltage has the same electric potential as the scan pulse, miss-discharge may be generated without the data pulse of the address electrodes X. Therefore, the voltage applied to the second half t3 and t4 in the address period of the first half scan electrode group is preferably smaller than the scan bias voltage and larger than the scan voltage for the scan pulse as described above.

In the first half t2 and t3 and the second half t3 and t4 of the address period, the pulse of the scan voltage is applied to the second half scan electrode group while maintaining the scan bias voltage Vsc such that the address discharge is performed.

Figure 3:
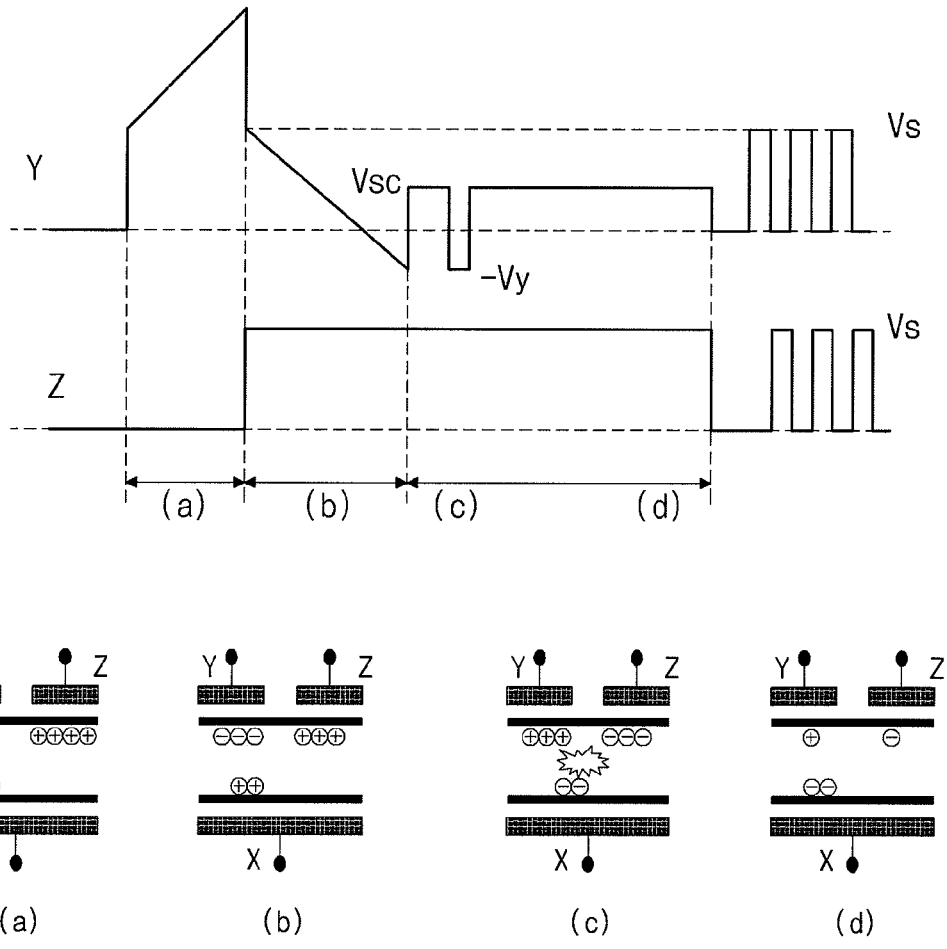
FIG. 3 illustrates the state of wall charges in accordance with the driving waveforms of the conventional PDP.

As described above, when the ground level lower than the scan bias voltage Vsc is maintained in the second half t3 and t4 in the address period of the first half scan electrode group, it is possible to prevent wall charges from being lost unlike the state of FIG. 3(*d*) in accordance with the conventional driving waveforms. That is, when the ground level lower than the scan bias voltage Vsc is maintained in the second half t3 and t4 in the address period of the first half scan electrode group, the lapse of time from after the address discharge to before the sustain discharge is longer than in the second half scan electrode group. Therefore, it is possible to prevent positive wall charges from being lost. As a result, it is possible to stably perform the sustain discharge after the address discharge.

According to the above driving method, it is possible to prevent wall charges from being easily lost when resolution is high and the plasma display apparatus is driven at a high temperature. Also, according to the scan method performed in the address period, a single scan method which performs scanning with a single data driving part is more effective than a dual scan method which performs scanning with two data driving parts.

Figure 6:
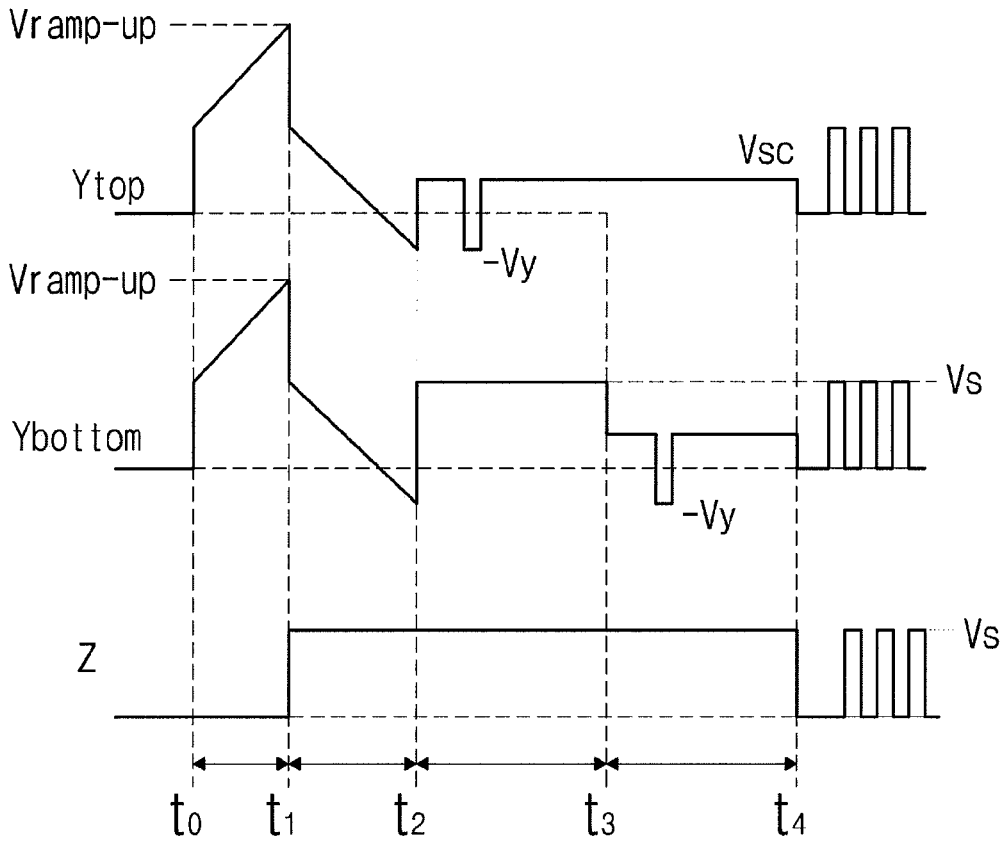
FIG. 6 illustrates waveforms for describing a second driving method of the plasma display apparatus according to the present invention.

FIG. 6 illustrates waveforms for describing a second driving method of the plasma display apparatus according to the present invention. As illustrated in FIG. 6, the second driving method of the plasma display apparatus according to the present invention is the same as the first driving method according to the present invention. According to the second driving method, the scan electrodes Y formed in the PDP are divided into tow groups, that is, the first half scan electrode group $Y_{top}$ and the second half scan electrode group $Y_{bottom}$ to be driven.

The reset pulse is simultaneously applied to the first half scan electrode group and the second half scan electrode group divided into two groups in the reset period.

Then, the first half scan electrode group Ytop and the second half scan electrode group Ybottom are differently driven in the address period. That is, in the first half t2 and t3 and the second half t3 and t4 of the address period, the pulse of the scan voltage is applied to the first half scan electrode group while maintaining the scan bias voltage Vsc such that the address discharge is performed.

In the first half t2 and t3 of the address period, the sustain voltage is maintained in the second half scan electrode group. In the second half t3 and t4 of the address period, the pulse of the scan voltage is applied to the second half scan electrode group while maintaining the scan bias voltage Vsc such that the address discharge is performed. On the other hand, in FIG. 6, in the second half scan electrode group, the voltage maintained in the first half of the address period is described as the sustain voltage. However, the voltage larger than the scan bias voltage Vsc and smaller than the voltage of the ramp up pulse applied in the reset period may be applied.

As described above, when the sustain voltage larger than the scan bias voltage Vsc is maintained in the first half t2 and t3 in the address period of the second half scan electrode group, it is possible to prevent negative wall charges from being lost since the address discharge is generated later than in the first half scan electrode group. That is, in the second half scan electrode group, it is possible to prevent the negative wall charges accumulated in the reset period t0 to t2 from being lost such that it is possible to stably perform the address discharge.

Figure 7:
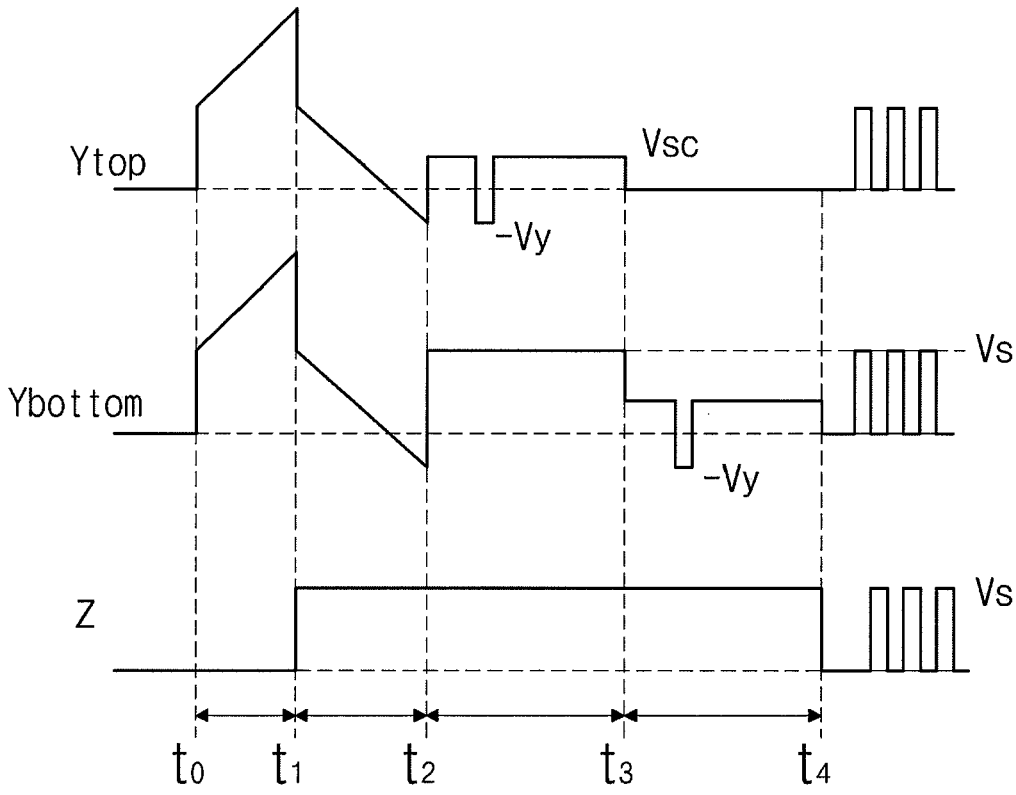
FIG. 7 illustrates waveforms for describing a third driving method of the plasma display apparatus according to the present invention.

FIG. 7 illustrates waveforms for describing a third driving method of the plasma display apparatus according to the present invention. As illustrated in FIG. 7, the third driving method of the plasma display apparatus according to the present invention is the same as the first and second driving methods according to the present invention. According to the third driving method, the scan electrodes Y formed in the PDP are divided into two groups, that is, the first half scan electrode group $Y_{top}$ and the second half scan electrode group $Y_{bottom}$ to be driven.

The reset pulse is simultaneously applied to the first half scan electrode group and the second half scan electrode group divided into two groups in the reset period like in the first and second driving methods.

Then, the first half scan electrode group $Y_{top}$ and the second half scan electrode group $Y_{bottom}$ are differently driven in the address period. As illustrated in FIG. 7, the first half scan electrode group is driven according to the first driving method of the plasma display apparatus of the present invention and the second half scan electrode group is driven according to the second driving method of the plasma display apparatus of the present invention.

Therefore, in the first half scan electrode group, it is possible to prevent positive wall charges from being lost after the address discharge such that the sustain discharge is stably performed. In the second half scan electrode group, it is possible to prevent the negative wall charged accumulated in the reset period t0 to t2 from being lost such that the address discharge is stably performed. As a result, discharge is stably performed when the plasma display apparatus is driven.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel in which a plurality of scan electrodes, sustain electrodes, and address electrodes are formed on substrates to form discharge cells; and electrode driving parts for driving the scan electrodes, the sustain electrodes, and the address electrodes respectively, wherein the plurality of scan electrodes are divided into a plurality of scan electrode groups, wherein a scan bias voltage is more than a ground level and a lowest voltage of a scan pulse voltage applied during an address period is lower than a lowest voltage of sustain pulses applied during a sustain period, wherein the electrode driving parts are configured to maintain a first voltage different from a scan bias voltage to a first half scan electrode groups where scanning is performed prior to a second half scan electrode groups among the plurality of scan electrode groups during a second half of the address period, the first voltage being lower than the scan bias voltage and higher than the scan pulse voltage, and wherein the electrode driving parts are configured to maintain a second voltage different from the scan bias voltage to the second half scan electrode groups where scanning is performed later than the first half scan electrode groups among the plurality of scan electrode groups during a first half of the address period, the second voltage being higher than the scan bias voltage and lower than a maximum voltage of a ramp up pulse applied in a reset period.

2. The plasma display apparatus as claimed in claim 1, wherein the first voltage is a ground voltage.

3. The plasma display apparatus as claimed in claim 1, wherein the second voltage is a sustain voltage.

4. The plasma display apparatus as claimed in claim 1, wherein the number of plurality of scan electrode groups is two.

5. The plasma display apparatus as claimed in claim 1, wherein the electrode driving parts are configured to maintain the sustain electrodes with a constant voltage during an entirety of the address period.

* * * * *